US005919590A

United States Patent [19]

Yu et al.

[11] Patent Number: 5,919,590

[45] Date of Patent: Jul. 6, 1999

[54] ELECTROSTATOGRAPHIC IMAGING MEMBER HAVING ABHESIVE ANTI-CURL LAYER

[75] Inventors: Robert C. U. Yu, Webster; Geoffrey M. T. Foley, Fairport; Satchidanand Mishra, Webster; Richard L. Post, Penfield; Yonn K. Rasmussen, Pittsford; John F. Yanus, Webster, all of N.Y.

[73] Assignee: Xerox Corporation, Stamford, Conn.

[21] Appl. No.: 09/196,518

[22] Filed: Nov. 20, 1998

[51] Int. Cl.[6] ..... G03G 5/04

[52] U.S. Cl. ..... 430/58; 430/56; 428/412; 428/447

[58] Field of Search ..... 430/56, 58; 428/412, 428/447

[56] References Cited

U.S. PATENT DOCUMENTS

| | | | |
|---|---|---|---|
| 4,654,284 | 3/1987 | Yu et al. | 430/59 |
| 4,942,105 | 7/1990 | Yu | 430/59 |
| 5,021,309 | 6/1991 | Yu | 430/58 |
| 5,051,328 | 9/1991 | Andrews et al. | 430/58 |
| 5,057,389 | 10/1991 | Nakayama et al. | 430/56 |
| 5,069,993 | 12/1991 | Robinette et al. | 430/58 |
| 5,707,767 | 1/1998 | Yu | 430/56 |

*Primary Examiner*—Roland Martin

[57] ABSTRACT

An electrostatographic imaging member comprising a supporting substrate having an electrically conductive layer, at least one imaging layer, an anti-curl layer, an optional ground strip layer and an optional overcoating layer, the anti-curl layer including a film forming polycarbonate binder, an optional adhesion promoter, a siloxane represented by the formula:

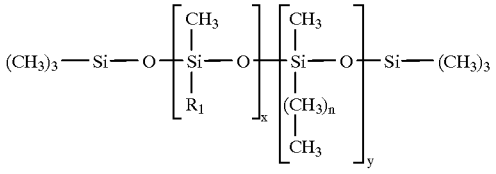

wherein x and y are independently selected integers between about 5 and about 500, n is a number between 0 and 10,

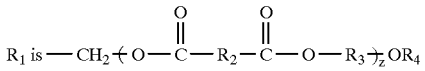

wherein z is number between about 1 and about 30, $R_2$ and $R_3$ are independently selected from alkylene groups containing from 1 to 10 carbon atoms, $R_4$ is a hydrogen atom or an alkyl group containing 1 to 3 carbon atoms, and optional dispersed particles selected from the group consisting of inorganic particles, organic particles, and mixtures thereof.

12 Claims, No Drawings

ELECTROSTATOGRAPHIC IMAGING MEMBER HAVING ABHESIVE ANTI-CURL LAYER

BACKGROUND OF THE INVENTION

This invention relates in general to electrostatography and, more specifically, to a flexible electrostatographic imaging member having a functionally improved anti-curl backing layer.

Flexible electrostatographic imaging members are well known in the art. Typical electrostatographic flexible imaging members include, for example, photoreceptors for electrographic imaging systems and electroreceptors such as ionographic imaging members for electrographic imaging systems. Generally, these imaging members comprise at least a supporting substrate layer and at least one imaging layer comprising thermoplastic polymeric matrix material. The "imaging layer" as employed herein is defined as the dielectric imaging layer of an electroreceptor or the photoconductive imaging layer of a photoreceptor. In a photoreceptor, the photoconductive imaging layer may comprise only a single photoconductive layer or a plurality of layers such as a combination of a charge generating layer and a charge transport layer.

Although the discussions hereinafter focus on electrophotographic imaging members, the problems encountered therewith are equally applicable to electrographic imaging members.

In the art of electrophotography, an electrophotographic imaging plate comprising at least one photoconductive insulating layer is imaged by first uniformly depositing an electrostatic charge on the imaging surface of the electrophotographic imaging plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in electrophotographic imaging member may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. Generally, the two electrically operative layers are positioned on an electrically conductive layer with the photoconductive layer sandwiched between a contiguous charge transport layer and the conductive layer. During an electrophotographic imaging process, the outer surface of the charge transport layer is normally charged in the dark with a uniform negative electrostatic charge and the conductive layer is utilized as a positive electrode. The photoconductive layer is capable of photogenerating holes and injecting the photogenerated holes into the contiguous charge transport layer. The charge transport layer in this embodiment must be capable of supporting the injection of photogenerated holes from the photoconductive layer and transporting the holes through the charge transport layer. In flexible electrophotographic imaging members, the electrode is normally a thin conductive coating supported on a thermoplastic resin web. Obviously, the conductive layer may also function as a negative electrode when the charge transport layer is sandwiched between the conductive layer and a photoconductive layer which is capable of photogenerating electron/hole pairs and injecting the photogenerated holes into the charge transport layer when the imaging member surface is uniformly charged with a positive charge while the conductive layer beneath serves as a negative electrode to receive the injecting holes. The charge transport layer in this embodiment, again, is capable of supporting the injection of photogenerated holes from the photoconductive layer and transporting the holes through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium—tellurium, selenium—tellurium—arsenic, selenium—arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirely. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more photoconductive layers are applied to a flexible supporting substrate, it has been found that the resulting photoconductive member tends to curl. Curling is undesirable because different segments of the imaging surface of the photoconductive member are located at different distances from charging devices, developer applicators and the like during the electrophotographic imaging process thereby adversely affecting the quality of the ultimate developed images. For example, non-uniform charging distances can be manifested as variations in high background deposits during development of electrostatic latent images. To eliminate the imaging member curling problem, a coating solution may be applied to the side of the supporting substrate opposite the photoconductive layer after drying, to form an anti-curl layer after drying which counteracts the tendency to curl and to provide the desired imaging member flatness. Unfortunately, several difficulties have been encountered with this anti-curl layer.

In a typical 6,000 feet long roll of electrophotographic imaging member production webstock, the charge transport layer comes to intimate contact with the anti-curl coating. The high surface contact friction generated between the charge transport layer and the anti-curl coating have been found to cause the formation of dimples, creases, and localized delamination of internal imaging member layers. Moreover, areas of polymer deformation developed in the layers of the imaging member, again due to the high surface contact friction of charge transport layer against the anti-curl layer in the webstock roll, have also been implicated in water mark like copy printout defects as the imaging member webstock is converted into belts and cycled in electrophotographic imaging machines. Since the anti-curl layer is an exposed outermost layer, it has further been found that during cycling of the photoconductive imaging member belts in electrophotographic imaging systems, the relatively rapid wearing away of the anti-curl layer also results in the curling of the photoconductive imaging member. In some tests, the anti-curl layer was completely removed or worn away after 150 thousand to 200 thousand cycles. This anti-curl layer erosion problem is even more pronounced when photoconductive imaging members in the form of belts are supported by a belt support module design which contains stationary guiding surfaces. During dynamic belt cycling, these stationary guiding surfaces, cause the anti-curl layer to wear away very rapidly and produce debris which scatters and deposits on critical machine components such as lenses, corona charging devices and the like, thereby adversely affecting machine performance. Since a typical anti-curl layer, using film forming polycarbonate such as Makrolon (available from Bayer AG), has a surface energy of approximately 42 dynes/cm, the anti-curl layer has the tendency to collect toner residues, dirt particles, and debris onto its outer surface and fuse them into comets as well as protrusion spots over the anti-curl layer surface which degrade the imaging belt cycling/motion quality and promote fatigue charge transport layer cracking.

Attempts have been made to overcome the above problems. However, the solution of one problem often leads to the creation of additional problems. For example, although the addition of micro-crystalline silica, at a 10 weight percent level in the anti-curl layer has been found to decrease charge transport layer/anti-curl layer surface contact friction and enhance wear resistance of the anti-curl layer, but excessive welding horn wear is observed when this electrophotographic imaging member belt is fabricated by the use of ultrasonically welding process of overlapping ends of an imaging member sheet. This wear is the result of the horn contacting with the melted anti-curl coating and charge transport layer materials when this molten mass is ejected to form splashing on either side of the overlapped ends.

It has also been observed that when conventional belt photoreceptors, using a bisphenol A polycarbonate (such as Makrolon, available from Bayer AG) anti-curl layer, are extensively cycled in precision electrophotographic imaging machines employed belt supporting backer bars and ROS exposure systems, an audible squeaky sound is generated due to high contact friction interaction between the anti-curl layer and the backer bars. Moreover, undesirable defect print marks are formed on copies as a result of localized cumulative deposition of toner particles, dirt, and debris brought by the anti-curl coating onto the surface of the backer bars. These deposits force the photoreceptor upwardly and interferes with the toner image development process. It is important to note that debris accumulation on the backer bars has also been found to gradually increase the dynamic contact friction of the two interacting surfaces, i.e., anti-curl layer and backer bars. This increase in dynamic contact friction forces a gradual increase in the duty cycle of the driving motor to a point where the motor eventually stalls and belt cycling prematurely ceases.

INFORMATION DISCLOSURE STATEMENT

U.S. Pat. No. 5,069,993 issued to Robinette et al on Dec. 3, 1991—An exposed layer in an electrophotographic imaging member is provided with increase resistance to stress cracking and reduced coefficient of surface friction, without adverse effects on optical clarity and electrical performance. The layer contains a polymethylsiloxane/polycarbonate diblock copolymer and an inactive film forming resin binder. Various specific film forming resins for the anti-curl layer and adhesion promoters are disclosed, for example in column 12, lines 57–65.

U.S. Pat. No. 5,021,309 issued to Yu on Jun. 4, 1991—In an electrophotographic imaging device, material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

U.S. Pat. No. 4,942,105 issued to Yu on Jul. 17, 1990—A flexible electrophotographic imaging member comprising at least one electrophotographic imaging layer, a supporting substrate layer having an electrically conductive surface and an anti-curl layer, the anti-curl layer comprising a film forming binder and from about 3 percent by weight to about 30 percent by weight, based on the total weight of said anti-curl backing layer, of a copolyester resin reaction product of terephthalic acid, isophthalic acid, ethylene glycol and 2,2-dimethyl-1-1-propane diol. This flexible electrophotographic imaging member is cycled in an electrostatographic imaging system to produce toner images.

U.S. Pat. No. 4,654,284 issued to Yu et al. on Mar. 31, 1987—An electrophotographic imaging member is disclosed comprising a flexible support substrate layer having an anti-curl layer, the anti-curl layer comprising a film forming binder, crystalline particles dispersed in the film forming binder and a reaction product of a bifunctional chemical coupling agent with both the binder and the crystalline particles. The use of Vitel PE 100 in the anti-curl layer is described, for example, in the Working Examples.

Thus, the characteristics of electrostatographic imaging members comprising a supporting substrate, having a conductive surface on one side, coated over with at least one photoconductive layer and coated on the other side of the supporting substrate with an anti-curl layer exhibit deficiencies which are undesirable in automatic, cyclic electrostatographic copiers, duplicators, and printers.

SUMMARY OF THE INVENTION

It is an object of the invention to provide an electrostatographic imaging member which overcomes the above-noted disadvantages.

It is still another object of this invention to provide an electrostatographic imaging member which resists delamination of inner coating layers.

It is yet another object of this invention to provide an electrostatographic imaging member having an anti-curl layer which has lower surface contact friction against the charge transport layer when the imaging member is in a roll of production webstock or in the form of final imaging member belt.

It is a further object of this invention to provide an electrostatographic imaging member with an improved anti-curl layer having a low surface energy.

It is still a further object of this invention to provide an electrostatographic imaging member with an improved anti-curl layer which prevents dirt particle, toner residue, debris, and paper fiber accumulation onto its surface.

It is also another object of the present invention to provide improved layered electrostatographic imaging members having a supporting substrate, a charge blocking layer, an optional adhesive layer, a charge generating layer, a charge transport layer, and an anti-curl layer free of localized layer delamination spots.

It is still a further object of the present invention to provide an improved layered flexible electrostatographic imaging web having an anti-curl layer which does not cause ultrasonic horn wear during the process of ultrasonic welding of seams to form belts.

It is also another object of the present invention to provide an improved layered flexible electrostatographic imaging belt which produces high quality images without copy printout defects.

It is yet another object of the present invention to provide an improved layered flexible electrostatographic imaging belt that prevents belt stall after extensive image cycling.

It is still yet another object of the present invention to provide an improved layered flexible electrostatographic imaging belt which eliminates an audible squeaky sound during machine operation.

These and other objects of the present invention are accomplished by providing an electrostatographic imaging member comprising a supporting substrate having an electrically conductive layer, at least one imaging layer, an anti-curl layer, an optional ground strip layer and an optional overcoating layer, the anti-curl layer comprising a film forming polycarbonate binder, an optional adhesion promoter, a liquid polysiloxane slip agent represented by the formula:

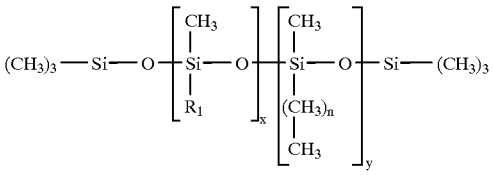

wherein x and y are independently selected integers between about 5 and about 500, n is a number between 0 and 10,

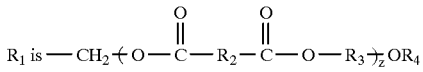

wherein z is number between about 1 and about 30, $R_2$ and $R_3$ are independently selected from alkylene groups containing from 1 to 10 carbon atoms, $R_4$ is a hydrogen atom or an alkyl group containing 1 to 3 carbon atoms, and optional dispersed particles selected from the group consisting of inorganic particles, organic particles, and mixtures thereof.

The electrostatographic imaging member is initially in the shape of a long web and is eventually formed into the shape of a flexible belt which may be utilized in an electrographic or electrophotographic imaging process.

Although the present invention is deemed to encompass both electroreceptor and electrophotographic imaging members, for the purpose of simplification and illustration only, the discussion hereinafter will focus primarily on electrophotographic imaging members.

Electrophotographic imaging members are well known in the art. Electrophotographic imaging members may be prepared by any suitable technique. Typically, a flexible substrate is provided with an electrically conductive surface. At least one photoconductive layer is applied to the electrically conductive surface. Thus, as well known in the art of electrophotography, a single photoconductive layer comprising photoconductive particles dispersed in an electrically active matrix may be applied or a plurality of photoconductive layers, such as a charge generating layer and a separate charge transport layer may be applied to the electrically conductive surface. A charge blocking layer may optionally be applied to the electrically conductive surface prior to the application of the at least one photoconductive layer. If desired, an adhesive layer may be utilized between the charge blocking layer and the photoconductive layer. Usually, for a negative charge imaging member, a charge generation layer is applied onto the blocking layer and a charge transport layer is subsequently formed over the charge generation layer. This structure may also have the charge generation layer on top of the charge transport layer to form a positive charge imaging member.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials here may be employed various resins known for this purpose including polyesters, polycarbonates, polyamides, polyimides, polyurethanes, polysulfones, and the like which are flexible as thin webs. An electrically conducting substrate may be any metal, for example, aluminum, nickel, steel, copper, and the like or a polymeric material, as described above, filled with an electrically conducting substance, such as carbon, metallic powder, conductive metal oxides, and the like or an organic electrically conducting material. The electrically insulating or conductive substrate may be in the form of an endless flexible belt, a web, a sheet, and the like.

In a typical electrophotographic imaging member, the thickness selected for the substrate layer depends on numerous factors, including mechanical strength and economical considerations, and thus, this layer for a flexible belt may, for example, have a thickness of at least about 50 micrometers, or of a maximum thickness of about 150 micrometers, provided there are no adverse effects on the final electrophotographic imaging device.

In embodiments where the substrate layer is not conductive, the surface thereof may be rendered electrically conductive by utilizing an electrically conductive coating. The conductive layer may vary in thickness over substantially wide ranges depending on the optical transparency and flexibility desired for the electrophotographic imaging member. Accordingly, when a flexible electrophotographic imaging belt is desired, the thickness of the conductive layer may be between about 20 angstrom units and about 750 angstrom units, and more preferably between about 50 Angstrom units and about 200 angstrom units for an optimum combination of electrical conductivity, flexibility and light transmission. The conductive layer may be an electrically conductive metal layer which may be formed, for example, on the substrate by any suitable coating technique, such as a vacuum depositing or sputtering technique. Typical metals include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

After formation of an electrically conductive surface, a hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may comprise nitrogen containing siloxanes or nitrogen containing titanium compounds as disclosed, for example, in U.S. Pat. No. 4,291,110, U.S. Pat. No. 4,338,387, U.S. Pat. No. 4,286,033 and U.S. Pat. No. 4,291,110, the disclosures of these patents being incorporated herein in their entirety. The blocking layer may be applied by any suitable technique such as spraying, dip coating, draw bar coating, gravure coating, silk screening, air knife coating, reverse roll coating, vacuum deposition, chemical treatment and the like. The blocking layer should be continuous and preferably has a thickness of less than about 0.2 micrometer.

An optional adhesive layer may be applied to the hole blocking layer. Any suitable adhesive layer may be utilized. One well known adhesive layer comprises a linear saturated copolyester reaction product of four diacids and ethylene glycol. This linear saturated copolyester consists of alternating monomer units of ethylene glycol and four randomly sequenced diacids in the above indicated ratio and has a weight average molecular weight of about 70,000 and a $T_g$ of about 32° C. If desired, the adhesive layer may comprise a copolyester resin. The adhesive layer comprising the polyester resin is applied to the blocking layer. Any adhesive layer employed should be continuous and, preferably, have a dry thickness between about 200 angstroms and about 3,000 angstroms and, more preferably, between about 400 angstroms and about 900 angstroms. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer. Typical application techniques include spraying, dip coating, roll coating, wire wound rod coating, and the like. Drying of the deposited coating may be effected by any suitable conventional technique such as oven drying, infra red radiation drying, air drying and the like.

Any suitable photogenerating layer may be applied to the blocking layer or adhesive layer, if one is employed, which can thereafter be overcoated with a contiguous hole transport layer. Examples of photogenerating layer materials include, for example, inorganic photoconductive materials such as amorphous selenium, trigonal selenium, and selenium alloys selected from the group consisting of selenium—tellurium, selenium—tellurium—arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diaminotriazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. Any suitable charge generating binder layer comprising photoconductive particles dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable inactive film forming resin materials may be employed in the photogenerating binder layer including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the resinous binder mature generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and therefore apply the photogenerating layer coating mixture. Typical application techniques include spraying, dip coating, roll coating, wire wound rod coating, vacuum sublimation and the like. Removal of the solvent of a solvent coated layer may be effected by any suitable conventional technique such as oven drying, infrared radiation drying, air drying and the like.

The active charge transport layer may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to an activating wavelength of light. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material which is an insulator to the extent that an electrostatic charge placed on the transport layer is not conducted in the absence of activating illumination.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer forming mixture preferably comprises an aromatic amine compound. An especially preferred charge transport layer employed in one of the two electrically operative layers in the multilayer-layer photoconductor of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2-methylphenyl) phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1'-biphenyl]-4,4'-diamine, 1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like. Molecular weights can vary, for example, from about 20,000 to about 1,500,000.

Examples of electrophotographic imaging members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures thereof being incorporated herein in their entirety.

Any suitable and conventional technique may be utilized to mix and thereafter apply the charge transport layer coating mixture to the charge generating layer. Typical application techniques include spraying, die casting, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used provided that there are no adverse effects.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the hole transport layer to the charge generator layer is preferably maintained from about 2.1 to 200:1 and in some instances as great as 400:1.

Other layers such as conventional ground strip layer comprising, for example, conductive particles dispersed in a film forming binder may be applied to one edge of the photoreceptor in contact with the conductive layer, hole blocking layer, adhesive layer or charge generating layer. The ground strip may comprise any suitable film forming polymer binder and electrically conductive particles. Typical ground strip materials include those enumerated in U.S. Pat. No. 4,664,995. The ground strip layer may have a thickness from about 7 micrometers to about 42 micrometers, and preferably from about 14 micrometers to about 23 micrometers.

Optionally, an overcoat layer may also be utilized to improve resistance to abrasion. In some flexible electrophotographic imaging members, an anti-curl layer may be applied to the side opposite the side bearing the electrically active coating layers in order to provide flatness and/or abrasion resistance.

The anti-curl layer of the present invention comprises a film forming polycarbonate binder, an adhesion promoter, a siloxane represented by the formula:

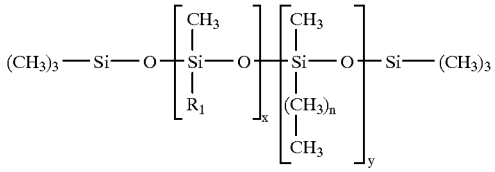

wherein x and y are independently selected integers between about 5 and about 500, n is a number between 0 and 10,

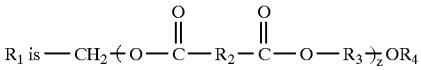

wherein z is number between about 1 and about 30, $R_2$ and $R_3$ are independently selected from alkylene groups containing from 1 to 10 carbon atoms, $R_4$ is a hydrogen atom or an alkyl group containing 1 to 3 carbon atoms, and optional dispersed particles selected from the group consisting of inorganic particles, organic particles, and mixtures thereof.

Polysiloxane liquids characterized by the formula above are commercially available slip agents, such as for example Byk 310®, available from Byk Chemie USA. The material is a chemically modified dimethlpolysiloxane oligomers in which some of the methyl groups are extended and altered to give long organic side chains that increase the compatibility of the polysiloxane molecule with the film forming polycarbonate of the anti-curl layer and provide good side chain mechanical anchoring to the material matrix of the resulting anti-curl layer. Still another polyester modified polysiloxane is Byk 370®, available also from Byk Chemie USA. Preferably, the dried anti-curl layer contains between about 0.01 and about 5 percent by weight of the polysiloxane slip agent, based on the total dry weight of the anti-curl layer. The dried anti-curl layer containing the polysiloxane slip agent has a surface energy of between about 40 dynes/cm and about 22 dynes/cm.

Any suitable film forming polycarbonate may be employed for anti-curl layer of this invention. Typical film forming polymer polycarbonates include, for example, bisphenol A type polycarbonate of 4,4'-isopropylidene (commercially available form Bayer AG as Makrolon) represented by the formulae:

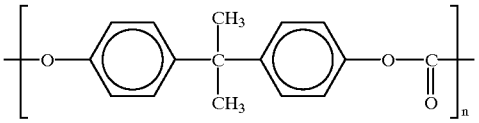

where n is the degree of polymerization;

poly(4,4'-diphenyl-1,1'-cyclohexane carbonate) represented by the formula:

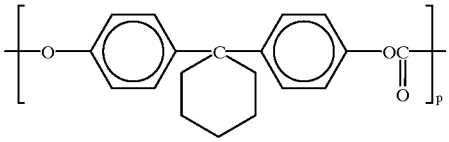

wherein p is the degree of polymerization, and the like. Anti-curl layers containing film forming polycarbonates such as bisphenol polycarbonate, poly(4,4'-isopropylidene diphenyl carbonate), 4,4'-cyclohexylidene diphenyl polycarbonate, and the like are described, for example in U.S. Pat. No. 5,069,993, the entire disclosure thereof being incorporated herein by reference. The polycarbonate resins typically having a weight average molecular weight from about 20,000 to about 120,000. Typical prior art anti-curl layers comprise polycarbonate, adhesion promoters, and optional inorganic or organic fillers or blend of these fillers. Preferably, the dried anti curl-layer of this invention contains between about 80 percent and about 99 percent by weight of the polycarbonate, based on the total weight of the anti-curl layer.

The anti-curl layer of this invention also contains an adhesion promoter in the matrix of the anti-curl layer. Any suitable adhesion promoter may be utilized. Typical adhesion promoters include, for example, polyesters, thermoplastic polyurethanes. polyacrylates, and the like. These adhesion promoters should be miscible with the polycarbonate and siloxane and soluble in the coating solvent. A preferred anti-curl layer adhesion promoter comprises a polyester additive. Especially preferred adhesion promoters include copolyesters, for example, du Pont 49,000 (du Pont), Vitel PE-100, Vitel PE-200, Vitel PE-307 (Goodyear), and the like. Usually from about 1 to about 20 weight percent adhesion promoter is selected for film-forming resin addition.

du Pont 49,000 is a linear saturated copolyester of four diacids and ethylene glycol having a molecular weight of about 70,000. The molecular structure of this copolyester is represented by the following:

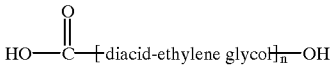

The ratio of diacid to ethylene glycol in the copolyester is 1:1. The diacids are terephthalic acid, isophthalic acid, adipic acid and azelaic acid in a ratio of 4:4:1:1.

Vitel PE-100 is a linear copolyester of two diacids and ethylene glycol having a molecular weight of about 50,000. Its molecular structure is represented by the following:

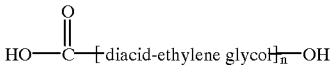

The ratio of diacid to ethylene glycol in the copolyester is 1:1. The two diacids are terephthalic acid and isophthalic acid in a ratio of 3:2.

Vitel PE-200 is a linear saturated copolyester of two diacids and two diols having a molecular weight of about 45,000. The molecular structure is represented by the following:

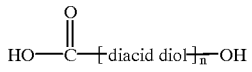

The ratio of diacid to diol in the copolyester is 1:1. The two diacids are terephthalic and isophthalic acid in a ratio of 1.2:1. The two diols are ethylene glycol and 2,2-dimethyl propane diol in a ratio of 1.33:1. Adhesion promoters used for anti-curl layer applications are described in U.S. Pat. No. 5,021,309, the entire disclosure of this patent being incorporated herein by reference.

Generally, the dried anti curl-layer contains between about 0.1 and about 30 percent by weight of the adhesion promoter, based on the total weight of the anti-curl layer. The preferred amounts vary with the specific adhesion promoter selected. For example, from about 0.1 weight percent to about 7 weight percent of PE100 may be used, with from about 0.1 weight percent to about 3 weight percent preferred, and, optimally, from about 0.5 weight percent to about 1.5 weight percent. With PE-200, PE-307 and du Pont 49,000, from 1 weight percent to about 30 weight percent may be used, with about 1 weight percent to about 20 weight percent preferred, and, optimally, from about 2 weight percent to about 10 weight percent.

Any suitable solvent for the siloxane, polycarbonate and adhesion promoter may be employed. Typical solvents include, for example, methylene chloride, toluene, tetrahydrofuran, cyclohexane, hexane, heptane, chlorobenzene, and the like. Generally, the weight proportions of soluble solids to solvent is between about 5:95 and about 15:85.

The anti-curl layer of this invention may optionally contain organic and/or inorganic particles dispersed therein. The particles are easily dispersed by conventional coating solution mixing techniques and result in no particle agglomerations in the anti-curl layer. The particles further have inherent wear resisting characteristics and are capable of providing lubricity to ease the sliding mechanical interaction at the charge transport layer surface. The particles have refractive indices closely matched with that of the polycarbonate so that particle dispersions in the anti-curl layer matrix do not affect the optical transmittance of the layer. Also, the presence of the particles produces no adverse impact on the electrical performance of the resulting photoconductive imaging member. An inorganic particle of particular interest is microcrystalline silica, a naturally occurring irregularly shaped quartz particle available, for example, from Malvern Minerals Company. Microcrystalline silica also exists in two other forms (christobalite and tridymite). The microcrystalline silica has a Moh Hardness Number of about 7 with excellent inherent abrasion resistance. Compared to the Moh Hardness Number of 5.5 for a synthetic amorphous silica counterpart, the microcrystalline silica is a mechanically superior filler for wear resistance enhancement. Other particulates of silica derivatives, such as micrometer size ground glass and micrometer size synthetic glass spheres (available from Cataphote Division, Ferro Corporation), may also be used. To improve particle-polymer interaction, the microcrystalline silica particles may be surface treated with bifunctional silane coupling agents. Preferred silane coupling agents available for silica particle treatment include chloropropyl triethoxy silane, having a molecular formula $Cl(CH_2)_3Si(OC_2H_5)_3$, and azido silane, having a molecular formula:

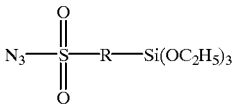

These silanes are employed in hydrolyzed forms because the OH groups of the hydrolyzed silanes readily react with the silanol functional groups of the microcrystalline silica surfaces and condense to form siloxane bonds at elevated temperature. The condensation reaction between the OH and silanol groups will position the siloxane at the surfaces of the silica particles and orient the organo-functional group outward to interact with the polycarbonate film forming polymer binder in the anti-curl layer matrix. The hydrolyzed silane solution which may be utilized to treat the microcrystalline silica may be prepared by hydrolyzing the alkoxy groups of a silane in an excess amount of water to form a dilute aqueous solution having about 0.1 weight percent to about 5.0 weight percent silane. A solution pH between about 9 and 13 is preferred. The control of the pH of the hydrolyzed silane solution may be achieved by acetic acid or hydrogen iodide addition. The silane microcrystalline silica surface treatment may be effected by washing the silica particles in the dilute hydrolyzed silane solution for about 1 minute to about 30 minutes. The resulting silica particles are filtered with a filter paper and dried at 135° C. in an oven for about 30 minutes to complete the silane surface treatment process. Alternatively, hydrolysis of the silane and surface treatment may also be effected directly at the surfaces of the microcrystalline silica particles as described, for example, in Example 2 of U.S. Pat. No. 3,915,735.

Other micrometer size inorganic particles having high hardness and exceptional wear resisting properties include, for example, diamond (Moh hardness 10), corundum (Moh hardness 9) and topaz (Moh hardness 8).

The organic particles selected for dispersion in the anti-curl layer include, for example, ALGOFLON, POLYMIST, and ACUMIST. ALGOFLON, available from Ausimont U.S.A., Inc., comprises irregular shaped polytetrafluoroethylene (PTFE) particles. This material has inherent slipping characteristics. When dispersed in the charge transport layer, ALGOFLON lowers the surface contact friction of the anti-curl layer and eases the sliding mechanical interaction of the surface to minimize wear. POLYMIST, available from Ausimont U.S.A., Inc., comprises irregular shaped PTFE particles which are similar to ALGOFLON, with the exception that the particles are gamma ray irradiated to increase their hardness. As a result of gamma ray irradiation, the POLYMIST exhibits improved wear properties when incorporated into the anti-curl layer. ACUMIST, available from Allied-Signal, Inc., comprises irregular shaped micronized waxy polyethylene particles having the molecular formula $CH_3(CH_2)_m CH_3$, in which m is a number of repeating units for a molecular weight between about 2000 and about 3500. The oxidized form of ACUMIST is a polyethylene homopolymer having a molecular formula $CH_3(CH_2)_m CH_2COOH$.

The above inorganic and organic particles, as supplied by the manufacturers, have particle size distributions from about 0.1 micrometer to about 9 micrometers in diameter. For anti-curl layer dispersions, these particles are classified to give a preferred particle diameter range between about 0.1 micrometer and about 4.5 micrometers, with an average particle diameter of about 2.5 micrometers.

The optional particulate material can be present in the anti-curl layer of the imaging member in a range up to about 20 percent by weight, preferably less than 10 percent by weight, based on the total weight of solids in the dried anti-curl layer. Optimum results are obtained when the coating mixture contains particulate material in a concentration of between about 0.5 percent by weight and about 5 percent by weight based on the total weight of solids in the dried anti-curl layer. When the optional particles are added to the anti-curl coating solution to form a coating dispersion, the solvent selected to apply the coating dispersion should not dissolve the particles.

Organic and inorganic particle dispersions are described in U.S. Pat. No. 5,096,795, the entire disclosure of this patent being incorporated herein by reference.

The anti-curl coating solution or dispersions of this invention can be applied by any suitable photoreceptor fabricating technique. Typical coating techniques include solvent coating, extrusion coating, spray coating, dip coating, lamination, solution spin coating and the like. The deposited coatings may be dried by any suitable drying technique, including, for example, such oven drying, forced air drying, circulating air oven drying, radiant heat drying, and the like.

The thickness of the anti-curl layer after drying depends on the degree of photoconductive imaging member curling caused by the charge transport layer. The thickness is from about 3 micrometers to about 35 micrometers, and preferably about 14 micrometers.

The electrophotographic imaging member embodiment of the present invention may be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation. Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the charged areas or discharged areas on the imaging surface of the electrophotographic member of the present invention. For example, for positive development, charged toner particles are attracted to the oppositely charged electrostatic areas of the imaging surface and for reversal development, charged toner particles are attracted to the discharged areas of the imaging surface. The electroreceptor embodiment of this invention may be utilized in any suitable electrographic imaging system in which a shaped electrostatic image is directly formed on a dielectric imaging layer by any suitable means such as styli, shaped electrodes, ion streams, and the like.

The anti-curl layer of this invention, obtained by incorporation of surface energy modifier, exhibits surface energy lowering, eliminates debris and dirt particles fusing to its surface, enhanced the physical/mechanical properties, as well as reduced surface contact friction between the anti-curl layer and the charge transport layer in electrophotographic imaging member webs that are rolled up for storage prior to cutting and seam welding into belts. The anti-curl layer of this invention maintains the optical clarity requirement of the anti-curl layer in the embodiment where light must be transmitted through the layer during electrophotographic imaging processes to ensure back erase.

PREFERRED EMBODIMENTS OF THE INVENTION

The invention will further be illustrated in the following non-limiting examples, it being understood that these examples are intended to be illustrative only and that the invention is not intended to be limited to the materials, conditions, process parameters and the like recited herein. All proportions are by weight unless otherwise indicated.

CONTROL EXAMPLE I

An electrophotographic imaging member was prepared by providing a 0.02 micrometer thick titanium layer coated on a polyester substrate (PET) (Melinex 442, available from ICI Americas, Inc.) having a thickness of 3 mils (76.2 micrometers) and applying thereto, using a $^{1}2$ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer was then allowed to dry for 5 minutes at 135° C. in a forced air oven. The resulting blocking layer had an average dry thickness of 0.05 micrometer measured with an ellipsometer.

An adhesive interface layer was then prepared by applying with a ½ mil gap Bird applicator to the blocking layer a wet coating containing 5 percent by weight based on the total weight of the solution of polyester adhesive (Mor-Ester 49,000, available from Morton International, Inc.) in a 70:30 volume ratio mixture of tetrahydrofuran/cyclohexanone. The adhesive interface layer was allowed to dry for 5 minutes at 135° C. in a forced air oven. The resulting adhesive interface layer had a dry thickness of 0.065 micrometer.

The adhesive interface layer was thereafter coated with a photogenerating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 grams polyvinyl carbazole and 140 mis of a 1:1 volume ratio of a mixture of tetrahydrofuran and toluene into a 20 oz. amber bottle. To this solution was added 8 grams of trigonal selenium and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis(3-methylphenyl)-1,1'-biphenyl-4,4'-diamine were dissolved in 75 ml of 1:1 volume ratio of tetrahydrofuran/toluene. This slurry was then placed on a shaker for 10 minutes. The resulting slurry was thereafter applied to the adhesive interface layer by using a ½ mil gap Bird applicator to form a coating layer having a wet thickness of 0.5 mil (12.7 micrometers). However, a strip about 10 mm wide along one edge of the substrate bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in a forced air oven to form a dry photogenerating layer having a thickness of 2.0 micrometers.

This coated imaging member web was simultaneously overcoated with a charge transport layer (CTL) and a ground strip layer using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4-4'-diamine and Makrolon 5705, a polycarbonate resin having a molecular weight of from about 50,000 to 100,000 commercially available from Farbenfabriken Bayer A.G. The resulting mixture was dissolved to give a 15 percent by weight solid in 85 percent by weight methylene chloride. This solution was applied onto the photogenerator layer to form a coating which upon drying had a thickness of 24 micrometers.

The approximately 10 mm wide strip of the adhesive layer left uncoated by the photogenerator layer was coated with a ground strip layer. This ground strip layer, after drying at 135° C. in a forced air oven for 5 minutes, had a dried thickness of about 14 micrometers. This ground strip is electrically grounded, by conventional means such as a carbon brush contact device during a conventional xerographic imaging process.

An anti-curl coating (ACL) was prepared by combining 8.82 grams of polycarbonate resin of 4,4'-isopropylidene diphenol (Makrolon 5705, having a molecular weight of about 120,000 and available from Bayer AG), 0.08 gram of copolyester resin (Vitel PE-100, available from Goodyear Tire and Rubber Company) and 90.1 grams of methylene chloride in a glass container to form a coating solution containing 9 percent solids. The container was covered tightly and placed on a roll mill for about 24 hours until the polycarbonate and polyester were dissolved in the methylene chloride to form the anti-curl curl coating solution. The anti-curl coating solution was then applied to the rear surface (side opposite the photogenerator layer and charge transport layer) of the imaging member with a 3 mil gap Bird applicator and dried at 135° C. for about 5 minutes in a forced air oven to produce a dried film thickness of about 13.5 micrometers and containing approximately 1 weight percent Vital PE-100 adhesion promoter, based on the total weight of the dried anti-curl layer. The resulting electrophotographic imaging member was used as a control to demonstrate an imaging member having a prior art anti-curl layer.

EXAMPLE II

An electrophotographic imaging member was prepared by following the procedures and using the same materials as described in the Control Example I, except that the anti-curl layer was incorporated with a polyester modified polysiloxane slip agent (Byk 310®, available from Byk-Chemie USA). The polysiloxane slip agent had a structure encompassed by the polysiloxane molecular structure shown hereinabove. This polysiloxane slip agent was a non volatile liquid readily dissolved into the anti-curl layer coating solution. After solution coating and drying at 135° C. for 5 minutes, the polysiloxane slip agent bloomed to the surface of the anti-curl layer and exposed the siloxane backbone to modify the surface energy of the exposed surface of the anti-curl layer while anchoring itself securely through extending the long organic side chains into the material matrix of the anti-curl layer. The resulting dry anti-curl layer was optically clear and contained 0.25 percent by weight polysiloxane slip agent.

EXAMPLE III

An electrophotographic imaging member was prepared by following the procedures and using the same materials as described in the Control Example I, except that the polysiloxane slip agent content in the dry anti-curl layer was 0.5 percent by weight.

EXAMPLE IV

An electrophotographic imaging member was prepared by following the procedures and using the same materials as described in the Control Example I, except that the polysiloxane slip agent content in the dry anti-curl layer was 1.0 percent by weight.

EXAMPLE V

An electrophotographic imaging member was prepared by following the procedures and using the same materials as described in the Control Example I, except that the polysiloxane slip agent content in the dry anti-curl layer was 2.0 percent by weight.

EXAMPLE VI

An electrophotographic imaging member was prepared by following the procedures and using the same materials as described in Example II, except that micro-crystalline silica particles (available from Malvern Minerals Company) were added into the anti-curl layer solution and dispersed, with the aid of the high shear disperser (Tekmar Dispak Disperser), in a water cooled, jacketed container to prevent overheating and loss of solvent due to evaporation. The particles had an average particle size of about 2.3 micrometers. The resulting anti-curl layer of this invention had a dry thickness of about 13.5 micrometers and contained 1.5 percent by weight of micro-crystalline silica and 0.25 percent by weight polysiloxane slip agent, based on the total weight of the dried anti-curl layer. Since the refractive index of the micro-crystalline silica is closely matched to that of the matrix polymer, the dry anti-curl layer was optically clear.

EXAMPLE VII

The electrophotographic imaging members of Control Example I as well as Examples II through VI were evaluated for interfacial contact friction between the charge transport layer and the anti-curl layer to assess the surface frictional interaction between these two contacting layers in a 6,000 foot wound up roll of imaging member webstock. Surface contact friction of the anti-curl layer of each imaging member against a machine belt support module drive-roll was also determined to ensure effective imaging member belt drive during cyclic electrophotographic imaging operations. The anti-curl layer of each of these imaging members was further investigated for adhesion to the substrate support, wear resistance, and relative surface abhesiveness. To evaluate the impact of the presence of the polysiloxane slip agent in the anti-curl layer on the ultrasonic seaming process employed for imaging member belts fabrication, the seam break strength of each imaging member was also measured and compared.

The coefficient of friction test was carried out by fastening a sample of an imaging member of each Example to a flat platform surface with the charge transport layer facing upwardly. Another sample of an imaging member from the same Example was secured to the flat surface of the bottom of a horizontally sliding plate weighing 200 grams, the anti-curl layer of the sample facing outwardly away from the sliding plate. The sliding plate was then dragged, with the anti-curl back coating facing downwardly, in a straight line over the platform so that the horizontal anti-curl layer surface moved while in frictional engagement with the horizontal charge transport layer surface. The sliding plate was moved by a cable having one end attached to the plate and having the other end threaded around a freely rotating pulley and fastened to the jaw of an Instron Tensile Tester. The pulley was positioned so that the segment of the cable between the weight and the pulley was parallel to the flat horizontal platform surface. The cable was pulled vertically upwardly from the pulley by the jaw of the Instron Tensile Tester and the load required to slide the sliding plate, with the anti-curl layer surface against the charge transport layer surface, was monitored using a chart recorder. The coefficient of friction between the charge transport layer (CTL) and the anti-curl layer (ACL) was then calculated by dividing the sliding force or load recorded by the chart recorder by 200 grams.

The coefficient of friction measurement was again repeated as above, but with the exception that the flat platform was anchored with a neoprene rubber to simulate the surface material of a drive roll and the value of the coefficient of surface contacting friction between each anti-curl layer and the rubber was also calculated by dividing the sliding force by 200 grams.

The 180° peel strength of the anti-curl layer over the substrate support was assessed by cutting a minimum of three 0.5 inch (1.2 cm.)×6 inches (15.24 cm.) imaging member samples from each of Control Example I and Examples II to VI. For each sample, the anti-curl layer was partially stripped from the test sample with the aid of a razor blade and then hand peeled to about 3.5 inches from one end to expose the substrate support layer inside the sample. This stripped sample was then secured to a 1 inch (2.54 cm.)×6 inches (15.24 cm.) and 0.05 inch (0.254 cm.) thick aluminum backing plate (having the charge transport layer facing the backing plate) with the aid of two sided adhesive tape. The end of the resulting assembly, opposite the end from which the anti-curl layer was not stripped, was inserted into the upper jaw of an Instron Tensile Tester. The free end of the partially peeled anti-curl layer was inserted into the lower jaw of the Instron Tensile Tester. The jaws were then activated at a one inch/mm crosshead speed, a two inch chart speed and a load range of 200 grams, to peel the sample at least two inches at an angle of 180°. The load was calculated to derive the peel strength of the sample. The peel strength was determined to be the load required for stripping the anti-curl layer divided by the width (1.27 cm.) of the test sample.

The electrophotographic imaging members of Control Example I and Examples II through VI were also each cut to a size of 1 inch (2.54 cm.) by 12 inches (30.48 cm.) and each tested for resistance to wear of the anti-curl layers. Testing was effected by means of a dynamic mechanical cycling device in which glass tubes were skidded across the surface of the anti-curl layer on each imaging member. More specifically, one end of the test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch width tension on the sample. The outer surface of the imaging member bearing the charge transport layer faced downwardly so that it would periodically be brought into sliding mechanical contact with the glass tubes. The glass tubes had a diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the outer surface of the charge transport layer. The axis of each glass tube was positioned about 4 cm from the shaft. The direction of movement of the glass tubes along the charge transport layer surface was away from the weighted end of the sample toward the end clamped to the stationary post. Since there were three glass tubes in the test device, each complete rotation of the disk was equivalent to three wear cycles in which the surface of the charge transport layer was in sliding mechanical contact with a single stationary support tube during the testing. The rotation of the spinning disk was adjusted to provide the equivalent of 11.3 inches (28.7 cm.) per second tangential speed. The extent of charge transport layer wear was measured using a permascope at the end of a 330,000 wear cycles test.

The anti-curl layer surface abhesiveness of each imaging member was determined by applying a 0.75 inch width Scotch Brand Magic Tape # 810, available from 3M Corporation, onto the anti-curl layer surface with rolling the adhesive tape over with a 5 lb weight to ensure uniform pressure, then followed by 180° tape peel test carried out according to the anti-curl layer adhesion peel test procedures described in above.

Each imaging member of the above was cut into 2 sheets, then brought together by overlapping one millimeter of the ends of the 2 sheets, followed by joining the ends with an ultrasonic welding process, at 40 kHz frequency, to form a welded seam. The seamed imaging members were each cut into a 0.5 inch or 1.27 cm width test sample, with the seam at the middle. Each sample was tension pulled using the Instron machine, with a 2 inch gauge length and 0.2 inch per minute crosshead speed, until the seam ruptured. The force required to rupture the seam divided by the width gives the seam break strength.

The results obtained for coefficient of surface contact friction measurements for each anti-curl layer (ACL) against charge transport layer (CTL) as well as against the rubber, ACL adhesion bond strength to the imaging member substrate (PET), ACL wear resistance, 180° tape peel strength, and each imaging member seam break strength are listed in the following Table:

TABLE

| Example | Slip Agent in ACL | Coefficient of Friction ACL & CTL | Coefficient of Friction ACL & Rubber | ACL/PET Peel Strength (gms/cm) | Thickness Wear Off (micrometers) | 180° Tape Peel Strength (grms/cm) | Seam Break Strength (kg/cm) |
|---|---|---|---|---|---|---|---|
| I(Control) | None | 3.17 | 1.08 | 7.4 | 10.0 | 441 | 9.92 |
| II | 0.25% | 1.68 | 1.06 | 8.6 | 8.8 | 252 | 10.23 |
| III | 0.50% | 1.62 | 1.07 | 8.3 | 7.9 | 244 | 10.17 |
| IV | 1.0% | 1.46 | 1.05 | 7.9 | 7.4 | 250 | 9.86 |
| V | 2.0% | 1.39 | 1.05 | 8.2 | 7.2 | 210 | 10.38 |
| VI | 0.25% & 1.5% Silica | 0.61 | 1.07 | 9.1 | 2.1 | 249 | 9.97 |

The data listed in the table above shows that the coefficient of surface contact friction between the charge transport layer and the anti-curl layer was substantially reduced from 3.17 to a lower value of between 1.68 and 1.39 when the anti-curl layer of the prior art electrophotographic imaging member of Control Example I was replaced with the anti-curl layer of this invention. Since the presence of fillers in the anti-curl layer can create surface asperity to effect surface contact friction reduction, it is interesting to note that the invention anti-curl layer of Example VI containing 0.25% slip agent and 1.5% silica dispersion did, in comparison to all the others, further suppress the coefficient of friction against the charge transport layer to a low value of 0.61. The observed coefficient of friction reduction should resolve the puckering, dimples, coating layers delamination, and inner layers coating deformation problems seen in a conventional 6,000 feet roll-up electrophotographic imaging member webstock. It is important to note that the presence of slip agent in the anti-curl layer did not seem to impact frictional interaction of the anti-curl layer against the rubber. This relationship ensures imaging member belt drive integrity during electrophotographic image cycling on rubber surfaced drive rollers.

Although all anti-curl layers of this invention containing the polysiloxane slip agent exhibited improved wear resistance improvement, the addition of a silica dispersion to the anti-curl layer of this invention gave the best wear resistance enhancement.

The surface abhesiveness determination carried out by 180° tape peel test gave most dramatic surface energy modification outcome. The results obtained show that slip agent presence in the anti-curl layer could effectively increase the surface abhesiveness of the layer. The tape peel strength of 441 grams/cm (corresponding to about 45 dynes/cm surface energy) determined for the prior art anti-curl layer of Control Example I, could significantly be reduced to 252 grams/cm (corresponding to about 270 dynes/cm surface energy) when only 0.25 weight percent of the slip agent was added to the anti-curl layer and asymptotically reaching a low tape peel strength of 215 grams/cm (corresponding to about 22 dynes/cm surface energy) at a 2 weight percent slip agent level addition. These tape peel test results indicate that it is effectual to convert an adhesive anti-curl layer surface to an abhesive one with just a small amount of slip agent addition.

The presence of slip agent in the anti-curl layer, at all the tested levels, did not appear to interfere with the imaging member ultrasonic seam welding process and was not found to affect the resulting seam strength. An additional benefit observed was that the electrophotographic imaging members having the anti-curl layer of this invention described in Examples II to VI, like the imaging member of Control Example I, did not cause surface scratching nor exacerbate wear of the ultrasonic horn during seam welding to fabricate the belt.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrostatographic imaging member comprising a supporting substrate having an electrically conductive layer, at least one imaging layer, an anti-curl layer, an optional ground strip layer, and an optional overcoating layer, the anti-curl layer comprising a film forming polycarbonate binder, an optional adhesion promoter, a siloxane represented by the formula:

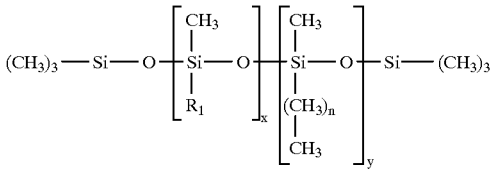

wherein x and y are independently selected integers between about 5 and about 500, n is a number between 0 and 10,

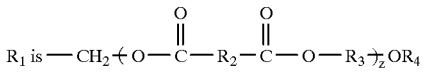

wherein z is number between about I and about 30, $R_2$ and $R_3$ are independently selected from alkylene groups containing from 1 to 10 carbon atoms, and $R_4$ is a hydrogen atom or an alkyl group containing 1 to 3 carbon atoms, and optional dispersed particles selected from the group consisting of inorganic particles, organic particles, and mixtures thereof.

2. An electrostatographic imaging member according to claim 1 wherein the at least one imaging layer comprises a charge generating layer and a charge transport layer of an electrophotographic imaging member.

3. An electrostatographic imaging member according to claim 1 wherein the at least one imaging layer comprises a dielectric imaging layer of an electrographic imaging member.

4. An electrostatographic imaging member according to claim 1 wherein the anti-curl layer of the imaging member comprises adhesion promoter present in an amount between about 0.1 and about 30 percent by weight, based on the total weight of the anti-curl layer after drying.

5. An electrostatographic imaging member according to claim 4 wherein the adhesion promoter is a copolyester.

6. An electrostatographic imaging member according to claim 1 wherein the anti-curl layer also comprises particles selected from the group consisting of organic particles, inorganic particles and mixtures thereof.

7. An electrostatographic imaging member according to claim 6 wherein the particles have an average size between about 0.1 micrometer to about 9 micrometers.

8. An electrostatographic imaging member according to claim 6 wherein the particles are present in the anti-curl layer in an amount up to about 20 percent by weight, based on the total weight of solids in the dried anti-curl layer.

9. An electrostatographic imaging member according to claim 1 wherein the anti-curl layer has a thickness between about 3 micrometers and about 35 micrometers after drying.

10. An electrostatographic imaging member according to claim 1 wherein the anti-curl layer comprises between about 0.01 and about 5 percent by weight of the siloxane, based on the total weight of the anti-curl layer after drying.

11. An electrostatographic imaging member according to claim 10 wherein the anti-curl layer comprises between about 80 percent and about 99 percent by weight of the polycarbonate, based on the total weight of the anti-curl layer after drying.

12. An electrostatographic imaging member according to claim 11 wherein the anti-curl layer has a surface energy of between about 40 dynes/cm and about 22 dynes/cm.

* * * * *